US010319288B2

(12) United States Patent
Kim et al.

(10) Patent No.: US 10,319,288 B2
(45) Date of Patent: Jun. 11, 2019

(54) OPTICAL ELEMENT OF LED DISPLAY APPARATUS AND LED DISPLAY APPARATUS

(71) Applicant: SAMSUNG ELECTRONICS CO., LTD., Suwon-si, Gyeonggi-do (KR)

(72) Inventors: Tae-woo Kim, Seoul (KR); Byong-heon Jeon, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 114 days.

(21) Appl. No.: 15/291,270

(22) Filed: Oct. 12, 2016

(65) Prior Publication Data

US 2017/0124938 A1 May 4, 2017

(30) Foreign Application Priority Data

Nov. 3, 2015 (KR) ..... 10-2015-0153865

(51) Int. Cl.
*G09G 3/32* (2016.01)

(52) U.S. Cl.
CPC ..... *G09G 3/32* (2013.01); *G09G 2320/0666* (2013.01); *G09G 2330/10* (2013.01); *G09G 2330/12* (2013.01); *G09G 2340/12* (2013.01)

(58) Field of Classification Search
None
See application file for complete search history.

(56) References Cited

U.S. PATENT DOCUMENTS 5,175,504 A * 12/1992 Henley ..... G09G 3/006 219/121.68
7,016,074 B1 * 3/2006 Fujita ..... H04N 1/502 358/1.9
9,072,149 B2 6/2015 Wu et al.
2002/0101558 A1 8/2002 Nemeth
2004/0196049 A1 10/2004 Yano et al.
2006/0232394 A1 10/2006 Patel
2007/0159750 A1 7/2007 Peker et al.
2009/0040775 A1 * 2/2009 Scheibe ..... G09F 9/33 362/373
2011/0007104 A1 * 1/2011 Nakazawa ..... G09G 3/3413 345/690
2012/0176039 A1 * 7/2012 Sato ..... H05B 33/0893 315/129

FOREIGN PATENT DOCUMENTS

EP 1 965 609 9/2008
KR 10-2013-0116126 10/2013

OTHER PUBLICATIONS

Search Report and Written Opinion dated Feb. 3, 2017 in counterpart International Patent Application No. PCT/KR2016/012425.

* cited by examiner

*Primary Examiner* — Sarah Le
(74) *Attorney, Agent, or Firm* — Nixon & Vanderhye P.C.

(57) ABSTRACT

A display apparatus and a controlling method thereof are provided. The method of controlling the display apparatus including a plurality of LED devices, includes determining whether a plurality of LED devices are open using, for example, a pin voltage connected to the plurality of LED devices, in response to an open LED device being present, determining a coordinate of the open LED device, processing an image so that a particular color is output in an area where the open LED device is located, and outputting the processed image.

12 Claims, 14 Drawing Sheets

OPTICAL ELEMENT OF LED DISPLAY APPARATUS AND LED DISPLAY APPARATUS

CROSS-REFERENCE TO RELATED APPLICATIONS

This application is based on and claims priority under 35 U.S.C. § 119 to Korean Patent Application No. 10-2015-0153865, filed in the Korean Intellectual Property Office on Nov. 3, 2015, the disclosure of which is incorporated by reference herein in its entirety.

BACKGROUND

1. Field

Apparatuses and methods disclosed herein relate generally to a display apparatus and a control method thereof, and for example, to a display apparatus and a control method thereof, which can determine a coordinate of an open LED, and process an image to output a particular color in an area where the determined coordinate of the open LED is located.

2. Description of Related Art

Unlike the conventional art where an LED device is only applied to simple products such as lighting or traffic lights, recent advancement of technology has expanded the market of a display using an LED device, a signage and a complex lighting, etc. Further, an LED device is applied in a small to mid-sized signage market as well as a large-sized signage market using an LED device.

When an LED device is open, the opened LED device malfunctions, but also, LED devices connected to the same cathode as the opened LED device malfunction as well.

Accordingly, there is a demand for overcoming the above physical drawback through a software operation by determining a coordinate of an open LED device and processing a particular color in an area where the coordinate of the open LED device is located

SUMMARY

One or more example embodiments provide a display apparatus, which, in response to an open LED being present, determines a coordinate of the open LED and processes an image to output a particular color in an area where the determined coordinate of the open LED is located, and a method for controlling the display apparatus thereof.

According to an example embodiment, a method of controlling a display apparatus comprising a plurality of LED devices is provided, the method including determining whether any of the plurality of LED devices are open using a pin voltage connected to the plurality of LED devices, in response to determining that an LED device is open, determining a coordinate of the open LED device, processing an image to output a particular color in an area where the open LED device is located based on the determined coordinate of the open LED device, and outputting the processed image.

Further, the processing an image may include processing the image such that a black image is overlaid with an area instead of an original input image where the determined coordinate of the open LED device is located and the overlaid black image is output where the determined coordinate of the open LED device is located.

The processing an image may include displaying the open LED device with black so that a black color is output in an area where the determined coordinate of the opened LED device is located.

The determining whether the LED device is open may include measuring a pin voltage connected to the plurality of LED devices and determining an LED device of which the measured pin voltage is greater than or equal to a predetermined threshold value as an open LED device.

The determining a coordinate of the open LED device may include determining the coordinate of the open LED device in any one of the cases where a predetermined period is reached and where a request for a coordinate of the open LED device is received.

The open LED device may be an LED device in which an anode which discharges current and a cathode which receives current are not connected to other LED devices.

According to an example embodiment of the present disclosure, a display apparatus may include a plurality of LED devices, a driver configured to operate the plurality of LED devices, and to determine whether any of the plurality of LED devices are open using a pin voltage connected to the plurality of LED devices, an image signal converter including image signal converting circuitry configured to, in response to an open LED device being present, determine a coordinate of the open LED device, and a processor configured to process an image to output a particular color in an area where the open LED device is located based on the determined coordinate of the open LED device, and to control the image signal converting circuitry to convert the processed image to a signal processable by the driver.

The processor may process an image such that a black image is overlaid with an area instead of an original input image where the determined coordinate of the open LED device is located and the overlaid black image is output where the determined coordinate of the open LED device is located.

The processor may process an image to display the open LED device with black so that a black color is output in an area where the determined coordinate of the open LED device is located.

The processor may measure a pin voltage connected to the plurality of LED devices, and control the driver to determine that an LED device having the measured pin voltage greater than or equal to a predetermined threshold value as an open LED device.

The processor may control the image signal conversion circuitry to determine a coordinate of an open LED device in any of the cases where a predetermined period is reached and where a request for the coordinate of the open LED device is received.

The open LED device may be an LED device in which an anode which discharges current and a cathode which receives current are not connected to other LED devices.

As described above, according to various example embodiments of the present disclosure, a coordinate of an open LED device is determined and an image is processed to output a particular color in an area where the determined coordinate of the open LED device is located, to thereby prevent and/or reduce peripheral LED devices of the open LED device from malfunctioning.

BRIEF DESCRIPTION OF THE DRAWINGS

The above and other aspects of the example embodiments will become more apparent from the following detailed description, taken in conjunction with the accompanying drawings, in which like reference numerals refer to like elements, and wherein.

DETAILED DESCRIPTION

Figure 1:
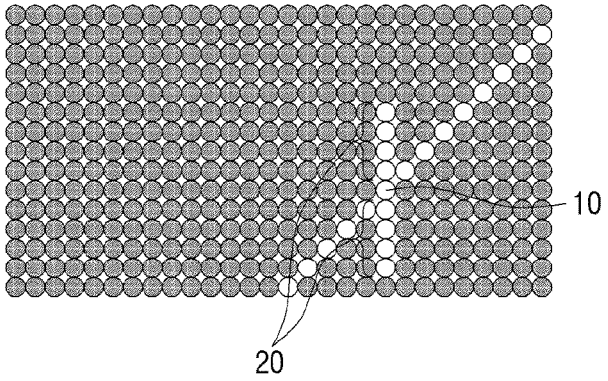
FIG. 1 is a diagram illustrating an example phenomenon where, in response to an open LED device being present, peripheral LED devices of the open LED device malfunction.

Hereinafter, the terms used in describing the example embodiments will be explained briefly, and example embodiments will be described in greater detail with reference to the accompanying drawings.

Although the terms used in the example embodiments are general terms which are widely used in the present time considering the functions in the present disclosure, the terms may be changed depending on an intention of a person skilled in the art, a precedent, and introduction of new technology. In addition, in a special case, arbitrarily selected terms may be used. In this case, the meaning of the terms will be explained in detail in the corresponding detailed descriptions or will be readily apparent therefrom. Therefore, the terms used in the example embodiments should be defined based on the meaning thereof and the descriptions of the present disclosure, rather than based on their names only.

Although the terms such as "first" and "second" may be used to explain various elements, the elements should not be limited by these terms. These terms may be used for the purpose of distinguishing one element from another element. For example, a first element may be named a second element without departing from the scope of right of the various example embodiments of the present disclosure, and similarly, a second element may be named a first element. The term "and/or" includes a combination of a plurality of described relevant items or any item of a plurality of described relevant items.

In addition, the singular forms are intended to include the plural forms as well, unless the context clearly indicates otherwise.

In addition, it should be understood that the terms "include" or "have" used in the example embodiments of the present disclosure may indicate the presence of features, numbers, steps, operations, elements, parts, or a combination thereof described in the specifications, and do not preclude the presence or addition of one or more other features, numbers, steps, operations, elements, parts, or a combination thereof.

In addition, "module" or "unit" used in the example embodiments perform at least one function or operation and may be implemented by using hardware (e.g., processing circuitry) or software or a combination of hardware and software. Further, except the "modules" or "units" that have to be implemented as certain hardware, a plurality of "modules" or a plurality of "units" may be integrated into at least one module and realized as at least one processor (not illustrated).

It will be understood that, when an element is mentioned as being "connected" to another element, the element may be "directly connected" to another element, and may be "electrically connected" to another element with an intervening element between the element and another element.

All of the terms used herein including technical or scientific terms have may refer to those generally understood by an ordinary skilled person in the related art unless they are defined otherwise. The terms defined in a generally used dictionary should be interpreted as having the same meanings as the contextual meanings of the relevant technology and should not be interpreted as having ideal or exaggerated meanings unless they are clearly defined in the various example embodiments.

Certain example embodiments are described in higher level detail below with reference to the accompanying drawings.

FIG. 1 is a diagram illustrating an example phenomenon where, in response to an open LED device being present among a plurality of LED devices included in a display apparatus, peripheral LED devices of the open LED device malfunction.

For example, an LED device in which an anode which discharges current and a cathode which receives current are not connected to other LED devices may refer to an "opened" or "open" LED device. Further, when data is input while an LED device is open, a current sink phenomenon where current backflows to power supply may be generated. Due to the current sink phenomenon, no voltage difference is generated and thereby, a cathode voltage becomes 0[v]. When a plurality of LED devices are connected to one cathode in common, it affects other LED devices connected to the cathode connected to the open LED device and thus, peripheral LED devices of the open LED device malfunction. Since a plurality of LED devices in vertical direction are mostly connected to a common cathode, in response to an open LED device 10 being present as illustrated in FIG. 1, mainly LED devices 20 positioned in a vertical direction of the open LED device 10 may malfunction. However, it is not limited thereto, and interference lighting may be generated in a horizontal direction as well.

Figure 2:
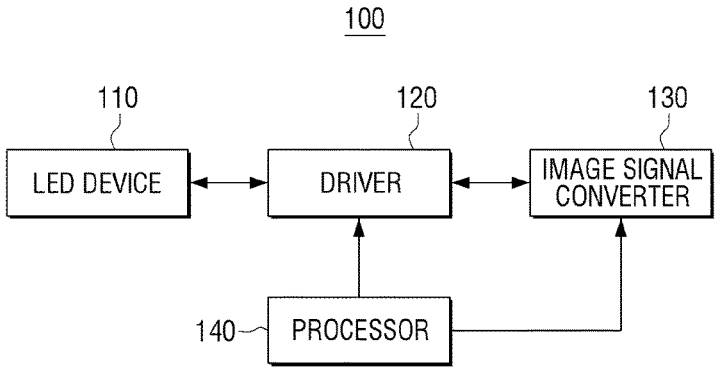
FIG. 2 is a block diagram illustrating an example display apparatus according to an example embodiment.

FIG. 2 is a block diagram illustrating an example display apparatus according to an example embodiment. As illustrated in FIG. 2, the display apparatus 100 includes a LED device 110, a driver (e.g., including driving circuitry) 120, an image signal converter (e.g., including image signal converting circuitry) 130, and a processor 140. According to an example embodiment, the display apparatus may be realized as various display apparatuses including, for example, and without limitation, an LED device, such as a TV, smart watch, smart glasses, desktop PC, etc., but is not limited thereto.

FIG. 2 illustrates various features in a brief manner, taking example of an apparatus including various functions, such as displaying function using a plurality of LED devices, etc. Therefore, some of the elements shown in FIG. 2 may be omitted or changed or another element may be added according to an example embodiment.

An LED device 110 may refer, for example, to a semiconductor device which sends current to a compound instead of a filament of a conventional light bulb to emit light. For example, the display apparatus 100 may include as many LED devices as the number of pixels to be adjusted by the pixel.

Further, the LED device 110 may include a number of rows and columns to display at least one of a video frame generated by processing image data received from an image receiver in an image processor and various screens generated in a graphic processor. In most display apparatuses, LED devices disposed in a same row may be connected to a common cathode. Therefore, when one LED device is open, the other LED devices connected to the same cathode as the open LED device may malfunction.

The driver 120 includes driving circuitry that will be well understood by those skilled in the art and may control an operation of the LED device 110, and determine whether the LED device is open using a pin voltage connected to the LED device. For example, the driver 120 may receive a signal from the image signal converter 130 to drive the LED device 110 to correspond to the received signal. The driver 120 may drive a plurality of LED devices.

Figure 3:
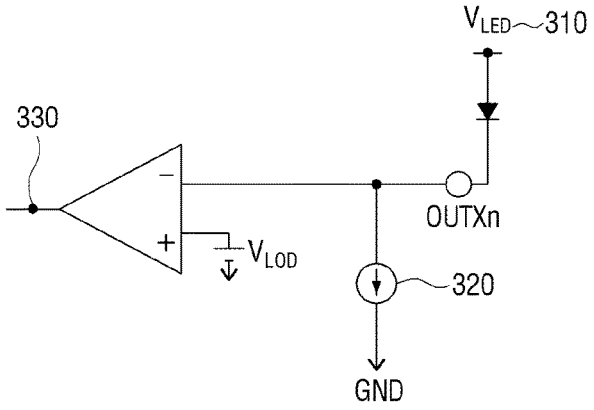
FIG. 3 is a circuit diagram illustrating an example method for determining whether an LED device is open, according to an example embodiment.

Further, the driver 120 may determine whether a plurality of LED devices are open. For example, each LED device 110 may be internally connected as illustrated, for example, in FIG. 3, and the driver 120 may thereby measure a voltage (Vled) 310 that flows through the LED device. Further, when the voltage (Vled) 310 that flows through the LED device 110 at the time of driving the LED device is greater than a predetermined threshold value, the driver 120 may determine that the LED device is open. Further, the driver 120 may output a signal 330 indicating whether the LED device 110 is open to the processor 140.

The image signal converter 130 includes various circuitry that determines a coordinate of an open LED device. Further, the image signal converter 130 may include circuitry configured to convert the signal received from the processor 140, and convert the received signal to a signal processable in the driver 120.

For example, the image signal converter 130 may transmit a request for data regarding an open LED device acquired by the driver 120 to the driver 120. When receiving the request for data regarding the open LED device, the driver 120 may transmit the data regarding the open LED device to the image signal converter 130. When receiving the data regarding the open LED device from the driver 120, the image signal converter 130 may determine a coordinate of the open LED device using data regarding the open LED device and information about a module number of each of a plurality of LED devices, a scan group, etc. In any of the cases where a predetermined period is reached or where a request for a coordinate of an open LED device is received from the processor 140, the image signal converter 130 may determine a coordinate of the open LED device.

In this example, the image signal converter 130 may include various image signal converting circuitry, such as, for example, and without limitation, a field programmable gate array (FPGA), processing circuitry (e.g., a CPU), or the like, and the image signal converter 130 may transmit or receive data to/from the driver via I2C communication using a clock and data (sda).

The processor 140 may control an overall operation of the display apparatus, and may include RAM, ROM, an image processor, a graphic processor, a main CPU, etc. (not shown).

ROM may store a command set for the system booting. When a turn-on command is input and thus the electric power is supplied, the main CPU may copy the stored O/S in the storage to RAM according to the commands stored in ROM, and boot the system by executing O/S. When the booting completes, the main CPU may copy the various application programs stored in the storage to RAM, and perform various operations by implementing the programs copied in RAM.

The image processor may convert the received image signal to a format that can be output. The image processor recognizes an image as a two-dimensional signal and processes an image or a moving image by applying a signal processing technique to the two-dimensional signal.

The graphic processor generates a screen including various objects, such as a pointer, an icon, an image, a text, and the like, using a computation unit (not illustrated) and a rendering unit (not illustrated). The computation unit computes an attribute value, such as a coordinate value where each object is displayed, a form, a size, a color, and the like, according to a screen layout using a control command received from the input unit. The renderer may generate the screens in various layouts including the objects based on the feature values calculated in the computation unit. The screen generated by the renderer is displayed on a display area of the display.

The main CPU accesses the storage to perform booting using an O/S stored in the storage. Further, the main CPU performs various operations by using the various programs, contents, and data stored in the storage.

For example, the processor 140 may process an image to output a particular color in an area where an open LED device is located based on a coordinate of the open LED device. The processor 140 may control the image signal converter 130 to convert the processed image to be processable by the driver 120 and transmit the converted signal to the driver 120. In this example, the particular color may be black, but it is not limited thereto.

For example, in response to an open LED device being present among a plurality of LED devices, the processor 140 may receive a coordinate of the open LED device from the image signal converter 130. The processor 140 may process the open LED device with black such that a black color is output in an area where a coordinate of the open LED device is located. Further, the processor 140 may transmit the signal which processed the open LED device with black to the image signal converter 130 so that a black color is output in an area where a coordinate of the open LED device is located. The processor 140 may control the image signal converter 130 to convert the signal which processed the open LED device with black to be processable by the driver. In this example, the processor 140 may transmit or receive data to/from the image signal converter 130 via I2C communication using a clock and data (sda).

Figure 4A:
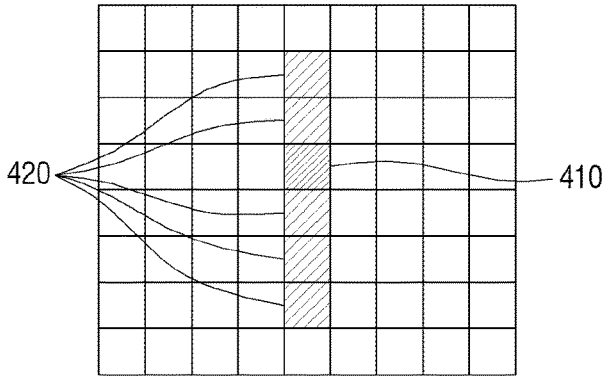
FIGS. 4A, 4B, 5A, 5B, 5C, 6A, 6B, 6C, 7A and 7B are diagrams illustrating example methods of processing an open LED device with a particular color to prevent and/or reduce malfunctioning of the peripheral LED devices, according to various example embodiments.
Figure 4B:
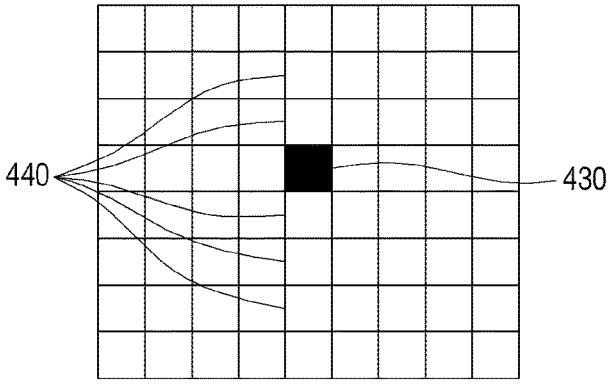

For example, as illustrated in FIG. 4A, in response to an open LED device 410 being present among a plurality of LED devices, LED devices 420 positioned in a vertical direction of the open LED device 410 may malfunction as well. Further, the processor 140 may receive a coordinate of the open LED device 410 from the image signal converter 130. The processor 140 may process the open LED device 410 with black such that a black color is output in an area where a coordinate of the open LED device 410 is located. Further, the processor 140 may transmit the signal which processed the open LED device with black to the image signal converter 130 so that a black color is output in an area where a coordinate of the open LED device is located. The processor 140 may control the image signal converter 130 to convert the signal which processed the open LED device with black to be processable by the driver. Further, as illustrated in FIG. 4B, the driver 110 may operate an open LED device 430 with black, and LED devices 440 positioned in a vertical direction may not malfunction.

According to another example embodiment, in response to an open LED device being present among a plurality of LED devices, the processor 140 may receive a coordinate of the open LED device from the image signal converter 130. The processor 140 may transmit a signal corresponding to an image which is black in an area instead of an original input image where a coordinate of the open LED device is located to the image processing converter 130, and control the image signal converter 130 to overlay the black image with an original input image and output the same. Further, the processor 140 may control the image processing converter 130 to convert the transmitted signal to a signal processable by the driver. Further, the processor 140 may transmit, to the image signal converter 130, a signal processed such that an original input image is overlaid with an image partially black in an area where a coordinate of the open LED device is located. Further, the processor 140 may control the image processing converter 130 to convert the transmitted signal to a signal processable in the driver. In this example, the processor 140 may transmit or receive data to/from the image signal converter 130 via I2C communication using a clock and data (sda).

Figure 5A:
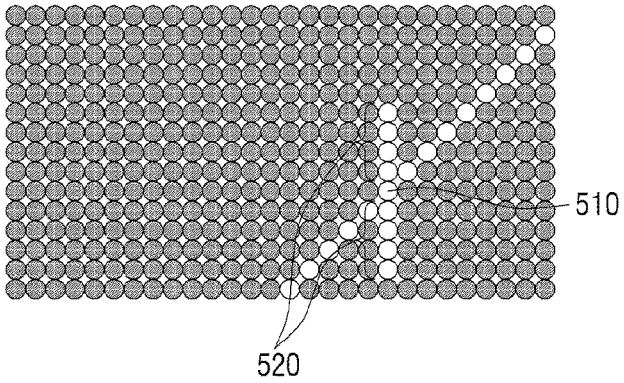
Figure 5B:
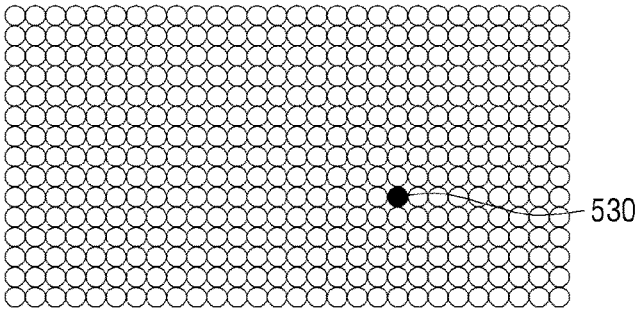
Figure 5C:
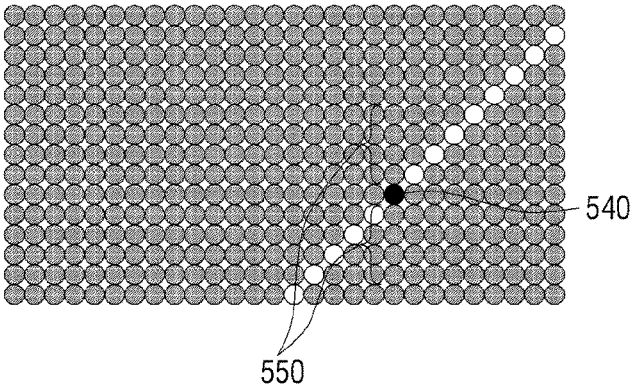

For example, as illustrated in FIG. 5A, in response to an open LED device 510 being present among a plurality of LED devices, LED devices 520 positioned in a vertical direction of the open LED device may malfunction as well. Further, the processor 140 may receive a coordinate of the open LED device 510 from the image signal converter 130. As illustrated in FIG. 5B, the processor 140 may transmit, to the image processing converter 130, a signal corresponding an image partially black in an area instead of an original input image where a coordinate of the open LED device is located, and control the image processing converter 130 to overlay the image to an original input image and output the same. Further, the processor 140 may control the image processing converter 130 to convert the transmitted signal to a signal processable by the driver. Further, the processor 140 may transmit, to the image processing converter 130, a signal processed such that the original input image (FIG. 5A) is overlaid with the image (FIG. 5B) partially black 530 in an area where the coordinate of the open LED device is located. Further, the processor 140 may control the image processing converter 130 to convert the transmitted signal to a signal processable by the driver. As illustrated in FIG. 5C, the driver 110 may operate the open LED device 540 with black, so that the LED devices 550 positioned in the vertical direction may operate normally. In this example, the processor 140 may transmit or receive data to/from the image signal converter 130 via I2C communication using a clock and data (sda).

Further, in response to a plurality of open LEDs being present, the processor 140 may receive coordinates of a plurality of open LED devices from the image signal converter 130. Further, the processor 140 may process an image to output a particular color in an area where the plurality of open LED devices are located based on the coordinates of the plurality of open LED devices.

Figure 6A:
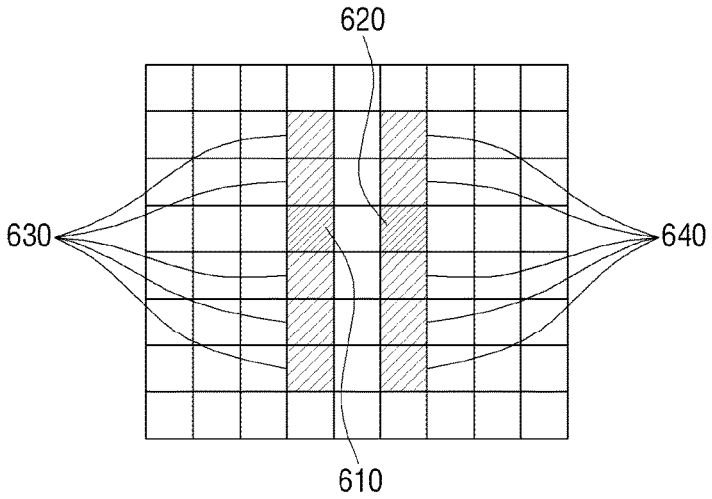
Figure 6B:
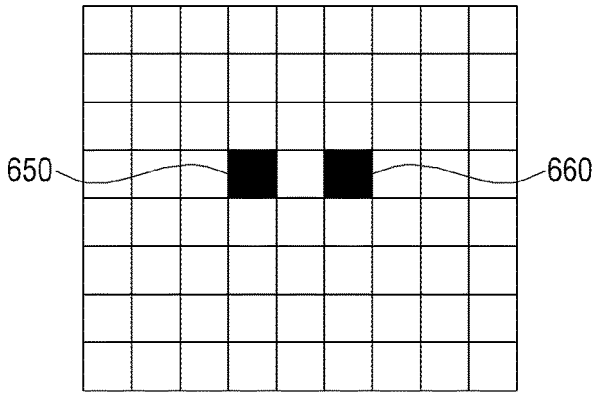

For example, as illustrated in FIG. 6A, in response to two open LED devices 610, 620 being present among a plurality of LED devices, LED devices 630, 640 positioned in a vertical direction of the two open LED devices 610, 620 may malfunction. Further, the processor 140 may receive coordinates of the two open LED devices 610, 620 from the image signal converter 130. As illustrated in FIG. 6B, the processor 140 may transmit, to the image processing converter 130, a signal corresponding to an image where each of areas 650, 660 where the coordinates of the two open LED devices are located is painted or outputs black, and control the image processing converter 130 to overlay it with an original input image and output the same. Further, the processor 140 may control the image processing converter 130 to convert the transmitted signal to a signal processable by the driver. Further, the processor 140 may transmit, to the image signal processor 130, a signal processed to overlay the original input image with the image where each of the areas 650, 660 where the coordinates of the two open LED devices are located is painted or outputs black. Further, the processor 140 may control the image processing converter 130 to convert the transmitted signal to a signal processable by the driver. Further, the processor 140 may process each of the two open LED devices 650, 660 with black to output black in each of the areas 650, 660 where the coordinates of the two open LED devices is located. Further, the processor 140 may transmit, to the image signal converter 130, a signal which processes the two open LED devices with black to output a black color in each of the areas 650, 660 where the coordinates of the two open LED devices are located. Further, the processor 140 may control the image signal converter 130 to convert the signal which processed each of the two open LED devices 650, 660 with black to be processable by the driver.

Figure 6C:
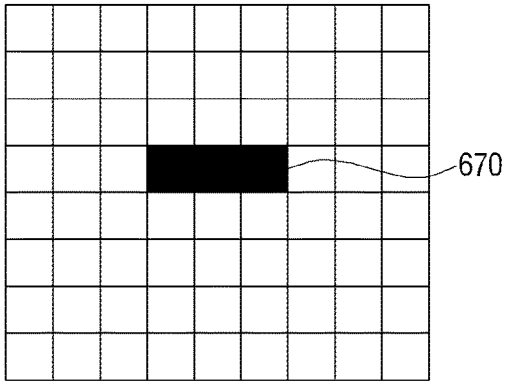

As another example, in response to receiving coordinates of the two open LED devices 610, 620 from the image signal converter 130, as illustrated in FIG. 6C, the processor 140 may transmit, to the image processing converter 130, a signal corresponding to an image which paints or outputs black in an area 670 including both coordinates of the two open LED devices 610, 620, and control the image processing converter 130 to overlay it with an original input image and output the same. Further, the processor 140 may control the image processing converter 130 to convert the transmitted signal to a signal processable by the driver. Further, the processor 140 may transmit, to the image signal converter 130, a signal processed such that the area 670 including an area where the coordinates of the two open LED devices 610, 620 are located with the original input image and outputted. Further, the processor 140 may control the image processing converter 130 to convert the transmitted signal to a signal processable by the driver. Further, the processor 140 may process, with black, an LED device positioned between two open LED devices and two other open LED devices such that the area 670 including both areas where the two open LED devices are located is output in black. Further, the processor 140 may transmit, to the image signal converter 130, a signal which is processed an LED device positioned between two open LED devices and two other open LED devices with black, so that an area where a coordinate of the LED device positioned between the two open LED devices and the two other open LED devices is located. Further, the processor 140 may control the image processing converter 130 to convert a signal which processed the LED device positioned between the two open LED devices and the two other open LED devices with black to a signal processable by the driver.

Figure 7A:
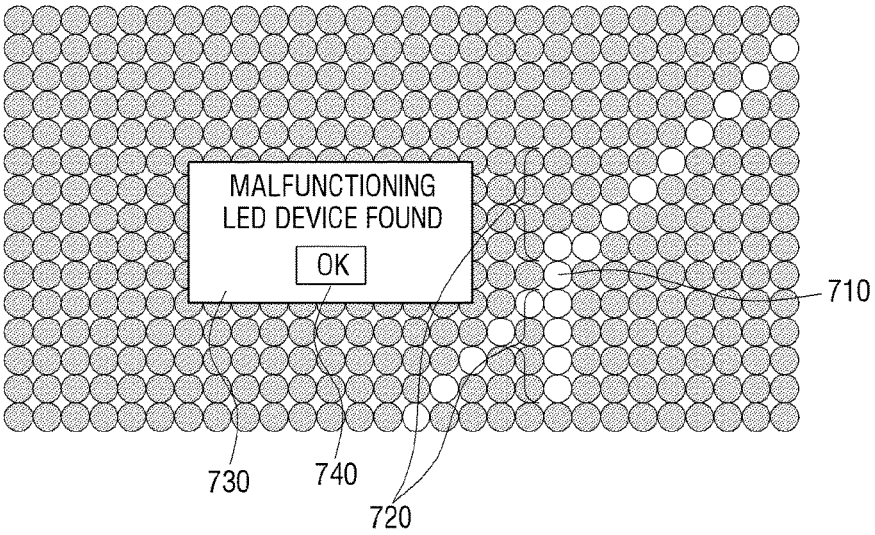
Figure 7B:
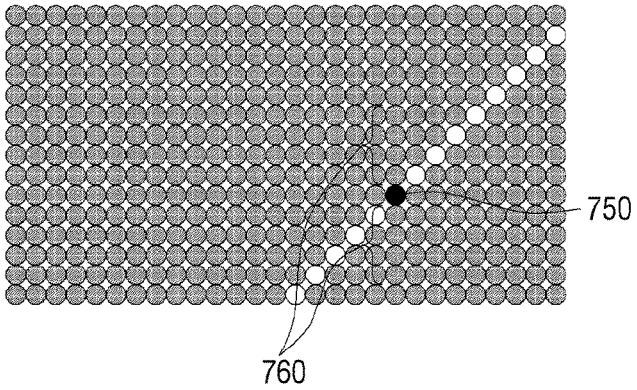

Further, as illustrated in FIGS. 7A and 7B in response to an open LED device 710 being present, the processor 140 may control the driver 120 to display a warning message 730 to notify that the open LED device 710 has been found. Further, in response to receiving a command to select "ok" 740 being input to process an area where the open LED device is located with a particular color, the processor 140 may process an area 750 where a coordinate of the open LED device is located with black and output the same, so that a malfunctioning LED 760 may operate normally.

The display apparatus 100 may include a storage (not illustrated). The storage stores various modules to drive the display apparatus 100. For example, software that includes a base module, a sensing module, a communication module, a presentation module, a web browser module, and a service module, or the like, may be stored on the storage. The base module may include a basic module configured to process signals transmitted from different hardware included in the display apparatus 100 and to transmit the processed signals to an upper level module. The sensing module may include a module configured to collect information from various sensors and to analyze and manage the collected information, and may include a face recognition module, a voice recognition module, a motion recognition module, a NFC recognition module, and the like. The presentation module may include a module configured to configure a display, and may include a multimedia module to reproduce and output multimedia content, a UI, and a UI rendering module to perform graphic processing. The communication module may include a module to communicate with an external entity. The web browser module may refer, for example, to a module configured to perform Internet browsing and access a web server. The service module may include a module that includes various applications to provide various services.

As described above, the storage may include various program modules, but some of the various program modules may also be omitted, changed, or added, according to a type and characteristics of the display apparatus 100. When the display apparatus 100 is realized as a tablet PC, for example, the base module may further include a GPS based position determination module to determine a position, and the sensing module may further include a sensing module to detect a user motion.

In this disclosure, the storage may be defined as including a Read Only Memory (ROM) in the processor 140, or a memory card (for example, a micro SD card, a memory stick) mounted in a Random Access Memory (RAM) or the display apparatus 100.

Further, the display apparatus 100 may include a communicator (not illustrated). The communicator may include various communication circuitry configured to communicate with external devices according to various kinds of communication protocols. The communicator may include various communication chips, e.g., circuitry, such as, for example, a Wi-Fi chip, a Bluetooth chip, a NFC chip, a wireless communication chip, and the like. A Wi-Fi chip, Bluetooth chip, and NFC chip may communicate in a Wi-Fi method, Bluetooth method, and NFC method. An NFC chip may refer, for example, to a chip that operates in a Near Field Communication (NFC) method which uses a 13.56 MHz-band from among various RF-ID frequency bands, such as 135 kHz, 13.56 MHz, 433 MHz, 860 to 960 MHz, and 2.45 GHz. When using the Wi-Fi chip or Bluetooth-chip, the communicator 250 may first transceive various connection information, such as an SSID, a session key, and the like, and connect to, using the information, communication and then transceive various information. The wireless communication chip may indicate a chip which performs communication according to various communication standards such as IEEE, ZigBee, 3rd Generation (3G), 3rd Generation Partnership Project (3GPP), Long Term Evolution (LTE), or the like.

Figure 8:
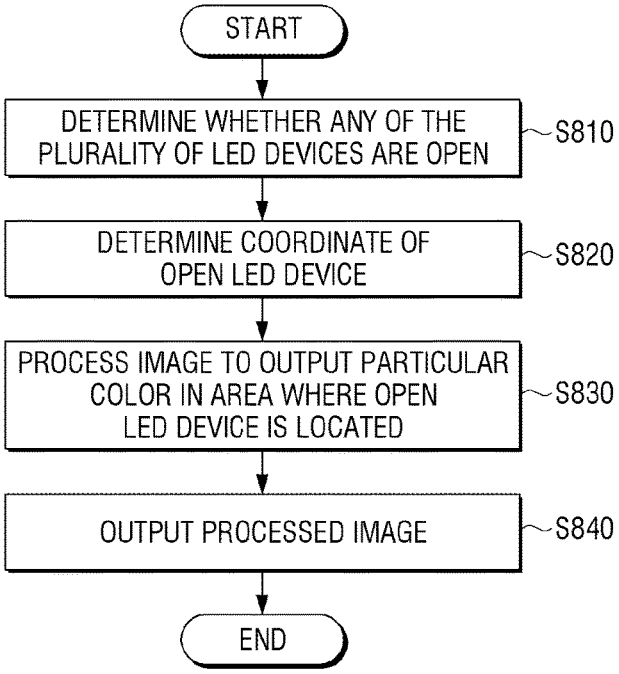
FIG. 8 is a flowchart illustrating an example method of controlling the display apparatus according to an example embodiment.

Hereinafter, a method for controlling a display apparatus 100 including a plurality of LED devices according to an example embodiment will be described with reference to FIG. 8.

The display apparatus including a plurality of LED devices determines whether any of the plurality of LED devices are open using, for example, a pin voltage connected to the plurality of LED devices, at operation 5810. For example, the display apparatus 100 may measure the pin voltage connected to the plurality of LED devices, and determine an LED device of which the measured pin voltage is greater than or equal to a predetermined threshold value as an open LED device.

Further, in response to an open LED device being present, the display apparatus 100 may determine a coordinate of the open LED device, at operation 5820. The display apparatus 100 may determine a coordinate of the open LED device in any of the cases where a predetermined period is reached or where a request for a coordinate of the open LED device is received.

Further, the display apparatus 100 may process an image such that a particular color is output in an area where the open LED device is located based on the determined coordinate of the open LED device, at operation S840. For example, the display apparatus 100 may process an image to overlay an image having a black color in an area instead of an original input image where the determined coordinate of the open LED device is located and output the same. Further, the display apparatus 100 may process an image to display the open LED device in black, so that an area where black color is output in the determined coordinate of the open LED device.

Further, the display apparatus 100 outputs the processed image, at operation S840.

According to the above-mentioned various example embodiments, the display apparatus 100 may process an image such that a particular color is output in an open LED device, to thereby prevent and/or reduce a malfunction of peripheral LED devices of the open LED device.

Meanwhile, the above-mentioned method may be executed by a program executable by a computer, and may be realized in a multi-purpose digital computer to operate the program using a computer-readable readable medium. Further, a structure of data used in the above-mentioned method may be recorded on a computer-readable recording medium through various means. The computer-readable recording medium includes a storage medium including magnetic storage media, such as ROM, floppy disk, hard disk, etc., and optical readable media, such as CD-ROM, DVD, etc.

It will be understood by those skilled in the art that the above-described method may also be changed within the spirit of the present disclosure. Thus, the above-described methods should not be considered as limiting but rather illustrative and explanatory. Therefore, the present disclosure should be construed as including all the changes, equivalents, and substitutions included in the spirit and scope of the present disclosure.

What is claimed is:

1. A method of controlling a display apparatus comprising a plurality of light emitting diode (LED) devices, the method comprising:

determining whether any of the plurality of LED devices are open;

in response to an determining that an open LED device is present, determining a coordinate of the open LED device;

processing an image to output a black color in an area where the open LED device is located based on the determined coordinate of the open LED device; and outputting the processed image.

2. The method as claimed in claim 1, wherein the processing an image comprises processing the image such that a black image is overlaid with an original input image where the determined coordinate of the open LED device is located, and the overlaid black image is output where the determined coordinate of the open LED device is located.

3. The method as claimed in claim 1, wherein the processing an image comprises displaying the open LED device with black so that a black color is output in an area where the determined coordinate of the open LED device is located.

4. The method as claimed in claim 1, wherein the determining whether the LED device is open comprises measuring a pin voltage connected to the plurality of LED devices and determining an LED device of which the measured pin voltage is greater than or equal to a predetermined threshold value as an open LED device.

5. The method as claimed in claim 1, wherein the determining a coordinate of the open LED device comprises determining the coordinate of the open LED device where a predetermined period is reached and where a request for a coordinate of the open LED device is received.

6. The method as claimed in claim 1, wherein the open LED device is an LED device in which an anode which discharges current and a cathode which receives current are not connected to other LED devices.

7. A display apparatus, comprising:

a plurality of LED devices;

a driver configured to operate the plurality of LED devices, and to determine whether any of the plurality of LED devices are open;

image signal converting circuitry configured to determine a coordinate of an open LED device, in response to an open LED device being present; and a processor configured to process an image to output a black color in an area where the open LED device is located based on the determined coordinate of the open LED device, and to control the image signal converting circuitry to convert the processed image to a signal processable by the driver.

8. The apparatus as claimed in claim 7, wherein the processor is configured to process an image such that a black image is overlaid with an original input image where the determined coordinate of the open LED device is located, and the overlaid black image is output where the determined coordinate of the open LED device is located.

9. The apparatus as claimed in claim 7, wherein the processor is configured to process an image to display the open LED device with black so that a black color is output in an area where the determined coordinate of the open LED device is located.

10. The apparatus as claimed in claim 7, wherein the processor is configured to determine a pin voltage connected to the plurality of LED devices, and to control the driver to determine that an LED device of which the determined pin voltage is greater than or equal to a predetermined threshold value as an open LED device.

11. The apparatus as claimed in claim 7, wherein the processor is configured to control the image signal converting circuitry to determine a coordinate of an open LED device where a predetermined period is reached and where a request for the coordinate of the open LED device is received.

12. The apparatus as claimed in claim 7, wherein the open LED device is an LED device in which an anode which discharges current and a cathode which receives current are not connected to other LED devices.

* * * * *